United States Patent [19]

Tholérus

[11] Patent Number: 5,066,183

[45] Date of Patent: Nov. 19, 1991

[54] METHOD FOR BINDING SHEAVES OF PAPER INTO COVERS

[75] Inventor: Jan Tholérus, Iäby, Sweden

[73] Assignee: Bindomatic AB, Stockholm, Sweden

[21] Appl. No.: 461,280

[22] Filed: Jan. 5, 1990

[30] Foreign Application Priority Data

Sep. 15, 1989 [SE] Sweden ..... 8903049

[51] Int. Cl.[5] ..... B42C 11/00

[52] U.S. Cl. ..... 412/4; 281/15.1; 281/21.1; 281/29; 281/51; 412/11; 412/12; 412/900

[58] Field of Search ..... 281/15.1, 21.1, 29, 281/51; 412/4, 11, 12, 900

[56] References Cited

U.S. PATENT DOCUMENTS

| | | | |
|---|---|---|---|
| 3,953,277 | 4/1976 | Kuhns | 412/900 X |
| 4,204,704 | 5/1980 | Staats | 281/29 X |
| 4,855,573 | 8/1989 | Vercillo et al. . | |
| 4,904,138 | 2/1990 | Champeaux et al. | 412/12 X |

FOREIGN PATENT DOCUMENTS

| | | | |
|---|---|---|---|
| 34818 | 3/1977 | Japan | 412/12 |
| 42208 | 4/1979 | Japan | 412/12 |
| 2072096 | 9/1981 | United Kingdom . | |

*Primary Examiner*—Paul A. Bell

*Attorney, Agent, or Firm*—Cooper & Dunham

[57] ABSTRACT

The invention relates to a method for binding sheaves of papers into covers such as to form booklets, each booklet comprising a cover made up of two cover sheets, a spine therebetween, and a binding agent attached to the inside of the spine, as well as a sheaf of papers inserted in the cover, one side edge of the sheaf being connected to the inside of the spine. The binding takes place by means of the binding agent being activated by an activation device such that the edge of the sheaf of papers will be connected to the inside of the spine via the binding agent. Each cover acts on a sensing means, which senses the presence or non-presence of indication means connected to the cover and which actuates means for influencing the further course of the method. The invention also relates to a cover provided with indication means sensed in the above described manner.

18 Claims, 4 Drawing Sheets

METHOD FOR BINDING SHEAVES OF PAPER INTO COVERS

DESCRIPTION

1. Technical field

The present invention relates to a method for binding sheaves of papers into covers such as to form booklets. More specifically, the invention refers to booklets each of which comprises a cover made up of two cover sheets, a spine therebetween, and a binding agent attached to the inside of the spine, as well as a sheaf of papers inserted between the two cover sheets, one side edge of the sheaf being connected to the inside of the spine by means of the binding agent. The invention also relates to a cover into which a sheaf of papers is to be bound.

2. Background art

Booklets of the kind described above are usually manufactured in the following way:

A flat sheet of paper and/or plastic is folded such that it is divided into two cover sheets and a spine. A binding agent in the form of a bead of melt glue is attached to the inside of the spine by firstly heating and melting the glue to a semi-solid state and then cooling it, so that it will solidify and adhere to the spine. The cover sheets are then folded along the crease lines such as to form a cover, the bead of glue being oriented between the cover sheets. When the finished covers have been packed and distributed, the user will take a cover out of the package and insert a sheaf of papers in the cover, such that one side edge of the sheaf will bear against the bead of glue. He will then insert the cover containing the sheaf of papers into a binding machine, such that the outside of the spine will get into contact with a heating plate. After a certain amount of time, the glue will melt and the sheaf of papers will sink into it. The user will then remove the cover containing the sheaf of papers from the machine and the glue will be allowed to cool, said side edge of the sheaf of papers adhering to the spine so that a finished booklet is obtained.

The above described method makes possible the manufacture of booklets of various kinds, the booklets being, for example, of different spine widths, dimensions and quality as regards both material of the cover and properties of the glue. It may, however, be difficult to see what kind of cover to be inserted in the binding machine and to adapt the machine to the covers to be bound, with respect to, for instance, the means retaining the covers and the means heating the glue. If said adaption cannot be made, the sheaf of papers may be incorrectly positioned in the cover, or binding may be incomplete. Further, it is not possible by means of the machine to obtain information on manufactured number of covers or booklets of various kinds.

DISCLOSURE OF INVENTION

It is an object of the present invention to eliminate the disadvantages of previously known methods for manufacturing booklets such that sheaves of papers will not be bound with faulty covers or covers not intended for the binding machine and such that information on number of manufactured covers of the same or similar kind can be obtained.

This object is achieved by the method and the cover according to the invention having been given the distinguishing features disclosed in the characterizing portions of the claims.

PREFERRED EMBODIMENT

Figure 1:
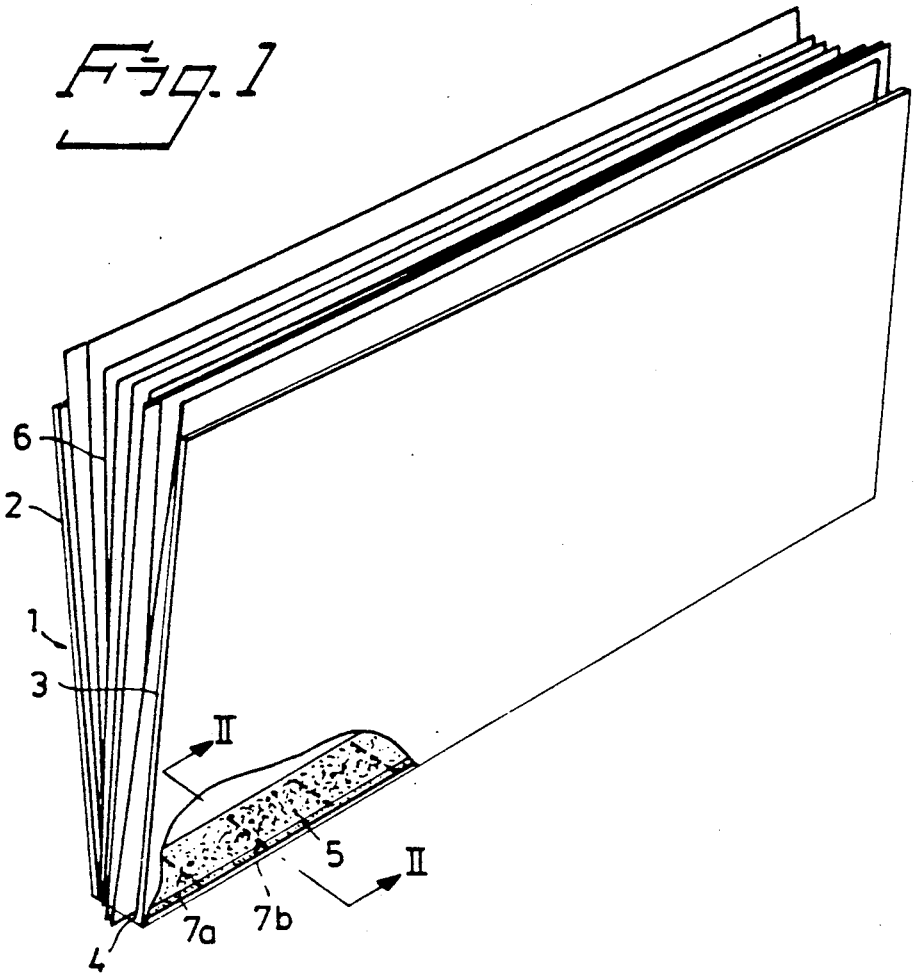
FIG. 1 is a partially cut perspective view of a cover with a sheaf of papers inserted in the cover but not yet attached to the same.

In FIG. 1 there is illustrated a cover 1 made from carton and/or plastic, which cover has been folded from a flat state into a shape as shown in FIG. 1 to form two cover sheets 2 and 3 and a spine 4. A binding agent 5 is attached to the inside of the spine and, if required, to the sections 2, 3 of the cover sheets 2, 3 adjacent to the spine. The binding agent 5 can be of any form and composition, however, preferably consists of a strip or bead of hot melt glue with substantially rectangular cross section, i.e. a glue which at room temperature is in a solid state and when heated to a higher temperature becomes semisolid or solid.

Figure 2:
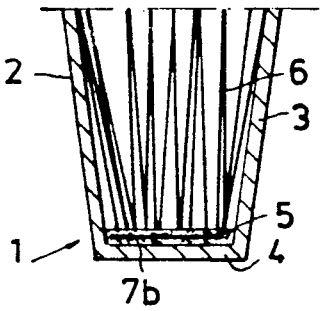
FIG. 2 is a sectional view along the line II—II of FIG. 1.

In FIGS. 1 and 2 there is depicted a sheaf of papers 6 consisting of a plurality of sheets of paper, which sheaf of papers is inserted in the cover such that one side edge of the sheets contained in the sheaf of papers is resting on the surface of the binding agent 5 farthest away from the spine 4. In this position, the cover containing the sheaf of papers is intended to be inserted and treated in the machine according to FIGS. 3–6 for connecting the sheaf of papers to the cover by means of the binding agent 5.

The cover 1, which by definition is assumed to comprise the cover sheets 2, 3, the spine 4 and the binding agent 5, is provided with automatically readable indication means 7, the function of which is to ensure that a different or faulty cover will not be treated by the machine according to FIGS. 3–6, which might then be destroyed, and/or to inform the user about the number of covers or booklets of varying spine widths being treated by the machine.

The indication means 7 can be formed and mounted in any of several possible ways, some of which will now be described. In FIGS. 1 and 2 there is illustrated a number of interspaced wires 7*a*, 7*b* etc. made from magnetizable or magnetic material and embedded in the binding agent 5. Number of wires, distances between them and/or wire thicknesses vary depending on the kind of cover. The indication means, which can be placed anywhere on the cover, is, however, preferably attached in the area of the spine 4 of the cover, for example, on any of the surfaces of the binding agent 5. The wires 7*a*, 7*b* etc. may be replaced by one or more strips of varying widths and/or can be located at different distances from each other to be significative of a certain kind of cover, for example a cover having a certain spine width.

The machine shown in FIGS. 3–6 is intended for the production of booklets, each of which of the kind comprising a cover 1 and a sheaf of papers 6 inserted in the cover as shown in FIGS. 1 and 2. It is not necessary for the sheaf of papers 6 to have been jogged up before insertion in the machine, nor does it have to be in the desired final position in the cover. Said condition is evident from FIG. 1.

Figure 5:
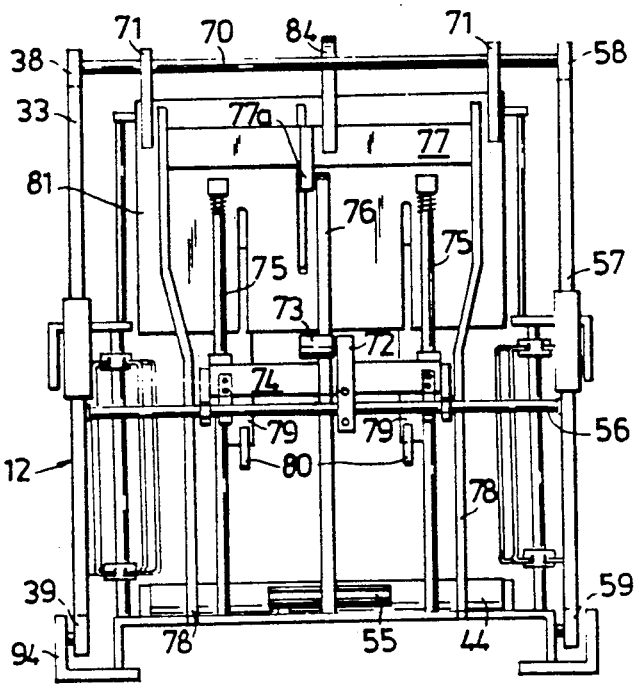
FIG. 5. is a side view of the machine according to FIG. 3, seen from the left.
Figure 6:
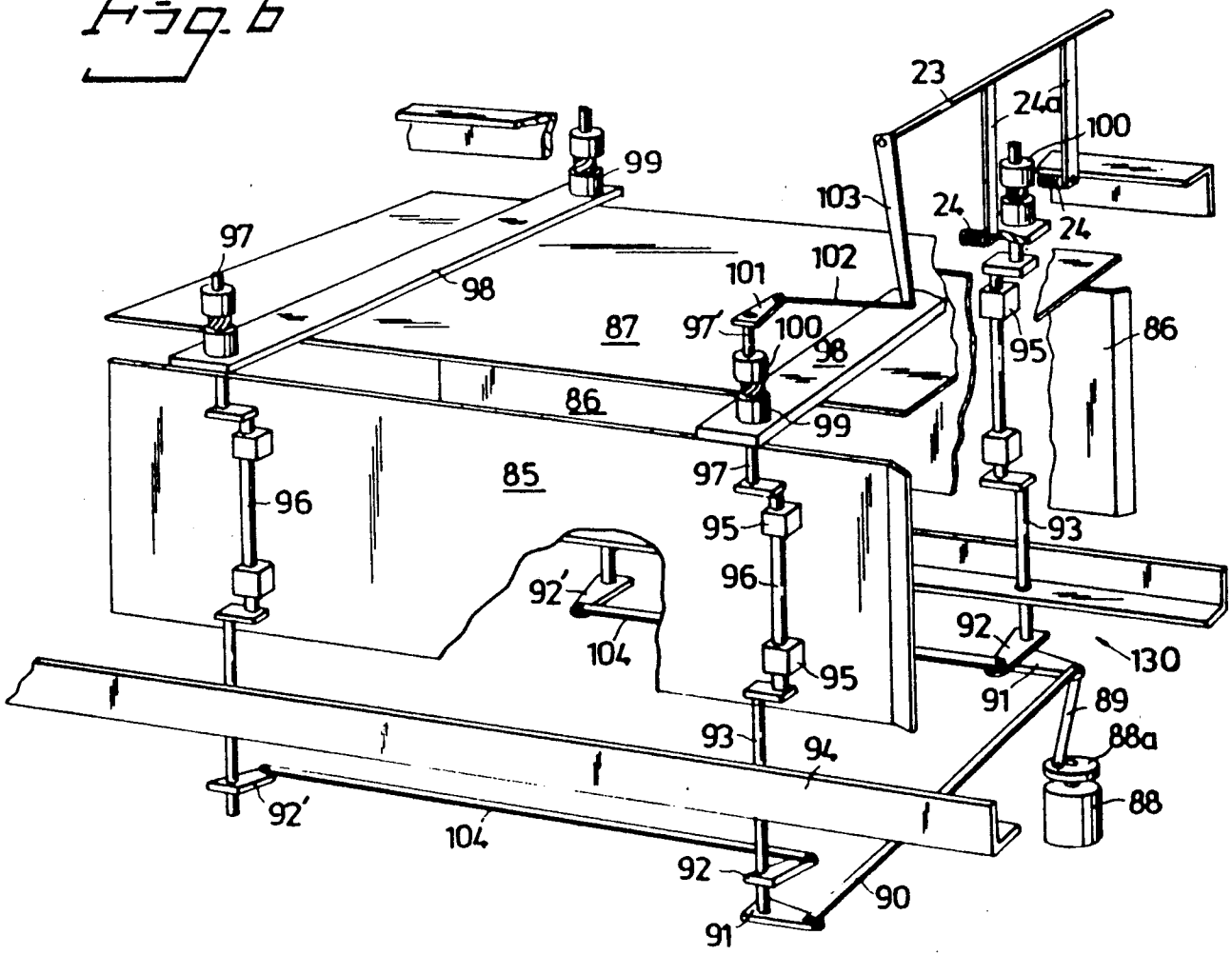
FIG. 6 is a schematic perspective view of, among others, a jogging device included in the machine according to FIGS. 3, 4 and 5.

The main parts of the machine are a magazine 8, in which covers 1 with inserted sheaf of papers 6 are deposited, an activation device 9 for heating and, if required, later cooling of the binding agent 5, and a reception space 10 for finished booklets. Further, the machine includes, among others, devices 11 and 12 (FIGS. 4 and 5) for transporting covers containing sheaves of papers from the magazine 8 to the reception space 10 and a jogging-up device 130 (FIG. 6). In order to make the machine as compact as possible and to facilitate insertion of covers containing sheaves of papers as well as removal of the finished booklets from the machine, the magazine 8 and the reception space 10 have been placed side by side and immediately above the activation device 9.

The magazine 8 is defined by a parallelepipedic space containing a transport device comprising two identical, parallel conveyors 13 and 14 which define two of the side walls of said space, and a base plate 15 fixed in the frame of the machine. Each conveyor 13, 14 includes two endless flexible cogged belts 16 as well as a number of wire bows 17 extending between the cogged belts and attached to these. The belts 16 are driven by cog wheels 18, of which those furthest to the right in FIG. 3 in each conveyor 13, 14 are driven by a shaft 19. The shafts 19 are continuously rotated in one direction by an electric motor 20 via interacting conical cog wheels 21*a* and 21*b*.

In each conveyor 13, 14 there are mounted two adjacent bows 17 providing support means which form a compartment and which are mounted at a mutual distance greater than the maximum occurring thickness of a cover 1 containing a sheaf of papers 6, meaning that two or more covers with inserted sheaf of papers of the minimum occurring thickness can be accommodated between the two bows. In this way, covers of different thicknesses containing sheaves of papers can be inserted in any order in the magazine 8 and yet be supported in substantially upright (vertical) positions in the magazine. Each cover 1 with sheaf of papers 6 is deposited in the magazine 8 between a pair of adjacent bows 17 in each conveyor 13, 14, with its spine 4 oriented downwardly and located in a horizontal position, and will be supported and carried by the bows, the opposing parts of the conveyor being at the same time moved to the right in FIG. 3 with the spines 4 of the covers in contact with the plate 15.

Immediately to the right of the conveyors 13 and 14, there are mounted two arms 24*a* on a horizontal shaft 23 which is pivotal in a reciprocating movement by means to be described below with reference to FIG. 6. At the open end of each arm 23 there is mounted a suction cup 24.

When a cover 1 containing a sheaf of papers 6 has been moved so far to the right in the magazine 8 that it leaves the plate 15, it will fall a short distance such as to come into contact with a plate 25 forming part of the machine frame. The spine 4 of the cover acts on a breaker 26 which will temporarily interrupt the travel of the conveyors 13, 14 and will pass an impulse to a suction pump (not shown) connected to the suction cups 24 to start working. At the same time, the pivoting shaft 23 will move the suction cups 24 towards the cover 1 which is resting on the plate 25 and will suck the cover such that it will adhere thereto. When the shaft 23 then pivots in the opposite direction, the suction cups 24 will carry the cover 1 containing a sheaf of papers 6 to the right in FIG. 3, so that it will leave the plate 25. When the cover 1 is then released by the suction cups 24, the spine 4 of the cover will get into contact with two steps 27 on a hoist made up of two arms 28 provided with pulleys 29, which are adapted to run vertically on rods 30 attached to the machine frame and extending almost along the entire height of the machine. The two arms 28 and pulleys 29 are connected to each other by means of an angled arm 31, the ends of which are attached to two flexible cogged belts 32 and 33 driven by a motor 22 via shafts driven by the motor, e.g. shafts 34*a* and 34*b*, the motor being provided with a reciprocating output shaft. The cogged belt 32 extends between cog wheels 34 and 35 and the cogged belt 33 between cog wheels 36–39.

As soon as the cover 1 containing a sheaf of papers 6 has been transferred to the steps 27 of the hoist 28, 29, 31, where it will be retained vertically by the arms 28, the cogged belts 32 and 33 will move the hoist downwardly towards the lower part of the machine. During the transfer, a sensing means 40 will sense whether the cover 1 with inserted sheaf of papers 6 can be accepted for continued processing in the machine and also senses the width of the cover spine. The sensing means 40 can be of previously known kind, comprising, for example, a magnet movably attached to one of the pulleys 29 for reciprocating travel immediately under the spine 4 in the area of the indication means 7. During its movement along the spine 4, the means 40 will sense the number of metal wires 7*a*, 7*b* etc. or other indication means and will signal to a suitable device (not shown) for adding and indicating total number of covers 1 of each spine width sensed. Further, the means 40 will signal to a magnet 41 to move a stop plate 42 attached to the lower part of the machine frame to an almost horizontal position if the cover is acceptable. Alternatively or in addition, the sensing means 40 can act on the activation device 9 such that the latter becomes idle, i.e. does not emit heat.

Figure 4:
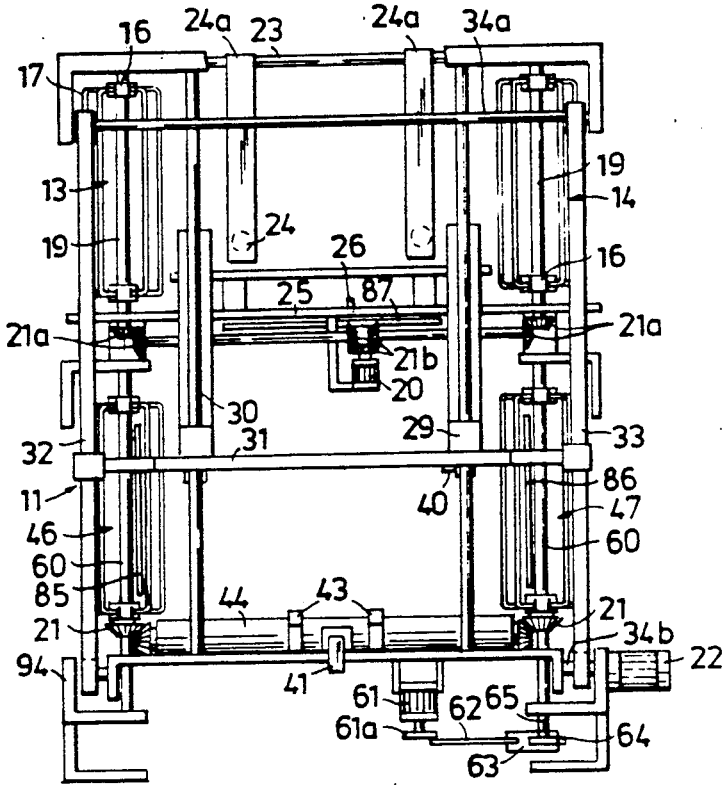
FIG. 4 is a side view of the machine according to FIG. 3, seen from the right.

When the hoist 28, 29, 31 reaches its lower end position the spine 4 of the cover 1 will come into contact with two surfaces 43 of the machine frame, which surfaces are inclined in an inward-downward direction. If the stop plate 42 has not been turned but is vertical, the cover with the sheaf of papers on continued movement of the hoist will slide on the surfaces 43, whereafter it will leave the hoist and fall into a slot between the hoist and a transport device 44 to enter, for example, into a space situated under the transport device. If, on the other hand, the stop plate 42 has been turned to an inclined, almost horizontal position in which it bridges the slot between the device 44 and the surfaces 43, the cover 1, on sliding on the surfaces 43, via the stop plate 42 will be moved to the transport device 44 where it will be gripped by conveyors 46 and 47, which are substantially identical to the conveyors 13, 14 except that the latter extend farther in the horizontal direction. The conveyors 46, 47 are mounted on shafts 60 which are step-operated and driven by a motor 61 in the opposite direction relatively to the conveyors 13, 14. The motor 61 has an eccentric disc 61*a* which via an arm 62 turns a latch 63 in a reciprocating movement. The latch 63 engages a ratchet 64, which in FIG. 4 gives a shaft 65 attached to the ratchet a step-by-step, anti-clockwise movement. The shaft 65 drives the shafts 60 via pairs of conical cog wheels 21 and a roller 50 extending between the cog wheels.

Figure 3:
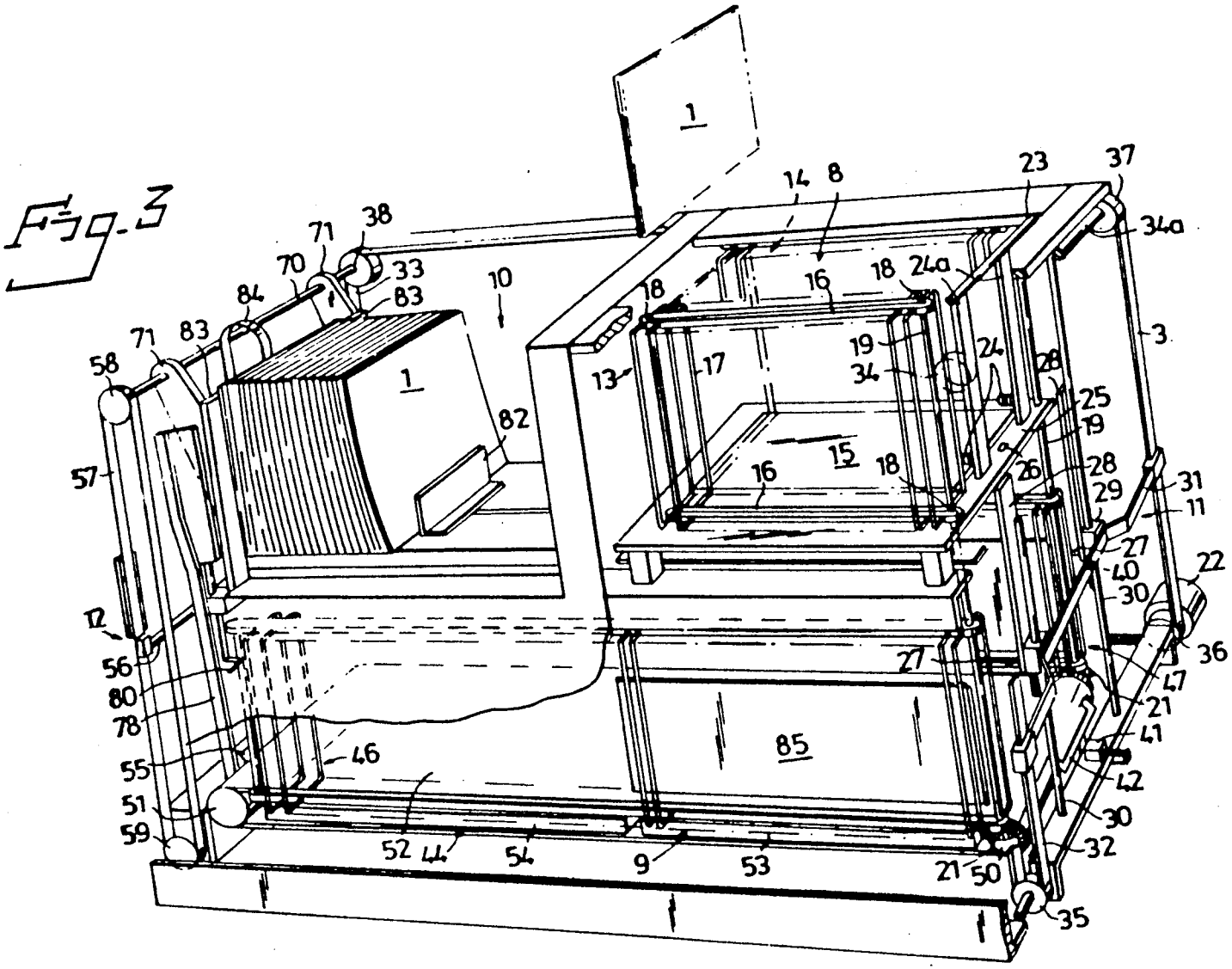
FIG. 3 is a partially cut perspective view of a machine for binding sheaves of papers into covers to the kind shown in FIGS. 1 and 2 so as to form booklets.

The transport device 44 includes at least one endless flexible conveyor belt 52 of suitable heat conducting material such as Teflon (registered trade mark), the upper part of which is moving step by step to the left in FIG. 3 at the same speed as the conveyors 46 and 47. The transport device 44 includes also the roller 50 and a roller 51, on which the belt 52 is mounted.

The activation device 9 is situated between the parts of the belt and projects sideways past the belt where it is attached to the machine frame. The device 9 includes also a heating plate 53 which emits a sufficient amount of heat to melt, via the belt 52, the melt glue bead 5 attached to the cover 1, so that said bead will become semisolid or almost liquid. The underside of the upper part of the belt 52 bears against, and slides on, the heating plate 53. If a different kind of binding agent, other than melt glue, is used, the activation device is adapted accordingly. In an alternative embodiment, the belt 52 may be formed as a heat source or other means for activating the binding agent.

Between the two parts of the belts 52, to the left of the heating plate 53 in FIG. 3, there is mounted a cooling plate 54; the upper part of the belt bearing against and sliding on the upper surface of the heating plate. In order to increase the degree of cooling, the underside of the heating plate 54 can be provided with cooling flanges, and/or a cooling fan can be installed in the machine. Alternatively, the plate 54 can be provided with channels for cooling water.

The conveyors 46 and 47 and the belt 52 running at the same speed move the cover 1 containing the sheaf of papers 6 to the left. During this movement, the melt glue is brought into a semisolid or almost liquid state and the sheaf of papers 6 will sink into the melt glue on the spine 4. Further, during said movement, the sheets of paper contained in the sheaf are jogged up in the sheaf and relatively to the cover by the jogging-up device 130 shown in FIG. 6 and to be described in more detail below. Already at this stage, it should, however, be pointed out that during jogging up, the covers and the sheaves of papers contained therein will be pressed against the heating plate 53 to increase heat transmission from the heating plate to the spine 4 of the cover via the belt 52.

The reason why the covers 1 do not get into direct contact with the heating plate 53 whilst moving over the same is that friction between covers and plate could result in scratching or dirtying of the outsides of the cover spines 4, which is a risk, especially when the covers are provided with printing ink.

When the cover 1 with the sheaf of papers 6 contained therein has passed the heating plate 53, it is moved (still by the conveyors 46, 47 and the belt 52) over the cooling plate 54, such that the melt glue, at least partially, will solidify. When the cover has passed the plate 54, the glue will have assumed a substantially solid state.

When the cover 1 containing a sheaf of papers 6, i.e. the finished booklet, has passed the transport device 44 it will fall into a chute 55 at the left-hand end of the device 44. From its position in the chute 55, the booklet is to be transported to the reception space 10, which is performed by the transport device 12 shown in FIG. 5. The device 12 consists of a hoist comprising a horizontal shaft 56, which at both ends is attached to the cogged belt 33 as well as to an endless cogged belt 57 running over cog wheels 58 and 59. The cog wheel 59 is rotatably mounted in the frame of the machine whereas the cog wheel 58 is attached to a shaft 70 which is rotatably mounted in bearing brackets 71. The cog wheel 38, which is attached to the other end of the shaft 70 and driven by the cogged belts 33, thus drives the shaft 70 which via the belts 33 and 57 gives the shaft 56 an upward-downward movement synchronous with the movements of the conveyors 46, 47 and of the transport device 44.

On the shaft 56, there is attached an angular holder 72 on which a roll 73 is rotatably mounted. The holder 72 is also pivotally mounted on a plate 54 which is attached to two rods 75 for vertical upward-downward movement. To the plate 74 there are attached two arms 79 supporting resilient hooks 80 oriented towards the machine. The roll 73 continuously bears against a fixed rail 76 in the machine frame. In FIG. 5, a projection **77*a* on a handrail 77 is situated beside the upper end of the rail 76 and in line with said upper end. The handrail 77 which by means of a spring 84 is pressed outwardly from the machine is attached to two arms 78** pivotally mounted in the lower part of the machine frame.

When the booklet has fallen into the chute 55, the hoist, i.e. the device 15, is brought to its lowest position, and the hooks 80 will be turned somewhat outwardly from the machine against the action of a light spring force by being pressed outwards by the booklet. On reaching its lowest position, the hooks 80 will be moved inwards by means of the spring force such as to assume a position under the spine 4 of the booklet. On subsequent rising of the hoist, the hooks will carry the booklet upwards. When, on ascending movement of the hoist, the roll 73 leaves the rail 76, it will forcibly press the projection **77*a* inwards towards the machine so that the handrail 77 will be passed through a fairly large recess in a panel 81 of the machine frame, moving the booklet now situated in line with the space 10 into said space, the booklet having previously passed two strips 83 situated at a mutual distance slightly less than the height of the booklet. A counterstay 82, which is resiliently pressed towards the strips 83, ensures that the booklets will always take up the positions shown in FIG. 3**.

After the cover has entered the space 10, the hoist, i.e. the device 12, is brought down to collect another cover situated in the chute 55.

In FIG. 6 there is illustrated the jogging-up device 130, comprising three panels 85, 86 and 87 and driving devices for same, as indicated in FIG. 4, of which panels at least panel 85 is shown in FIG. 3. A motor 88 which may be the same as the motor 61 is provided with an eccentric disc **88*a* on which an arm 89 is pivotally mounted. The arm 89 is pivotally connected to an arm 90 which is pivotally connected to pivoting pieces 91. The pivoting pieces 91 are fixedly connected to pivoting pieces 92 and shafts 93 pivotally mounted in beams 94 on the machine frame. Pivoting pieces 92', identical to the pivoting pieces 92, are pivotally connected to these by means of arms 104**.

The shafts 93 are provided with cranks 96 mounted in blocks 95 attached to the panels 85–87. The upper part of each crank 96 is attached to a shaft 97 extending through a beam 98 which is attached to the panel 87.

Above the beams 98 each shaft 97 is connected to a screw 100 engaging with a nut 99, which is attached to the upper side of the beam 98. The nut 99 is unrotatably attached to the machine frame but can be moved axially relative to the frame.

On rotation of the motor 88, the panels 85 and 86 will move towards and away from each other in the horizontal direction at a frequency determined by the speed of the motor. At the same time, the panel 87 will move towards and away from the activation device 9 because the axially immovable screws 100 on turning of the shafts 97 will be screwed into and out of the nuts 99 such that they will later be displaced axially, bringing the beams 88 and the panel 87 with them. Displacement of the panels 85–87 is effected immediately before and during activation of the binding agent 5 in the covers 1 by means of the device 9 in order to jog up the sheets 6 relatively to each other and relatively to the covers as well as to press the covers containing the sheets of paper against the activation device 9 (which is done by panel 87 only) to increase heat transmission to the binding agent.

One of the shafts 97, which is elongated and is referred to as 97', is provided with a pivoting piece 101 rotatably mounted on a rod 102 rotatably mounted on an arm 103 attached to one end of the shaft 23. On rotation of the shaft 97' in a reciprocating movement, the shaft 23 will be pivoted alternately clockwise and anti-clockwise to move the suction cups 24 towards and away from a cover 1 resting on the plate 25.

Although only one embodiment of the present invention has been shown on the drawings and only a few embodiments have been described above, it will be understood that the invention is not restricted to these embodiments but only by the statements of the claims.

I claim:

1. A cover comprising two cover sheets and a spine therebetween, a binding agent attached to the inside of the spine, a sheaf of papers being intended to be inserted in the cover between the two cover sheets, such that one side edge of the sheaf of papers bears against the side of the binding agent farthest away from the spine, the binding agent being intended to be activated for connecting the sheaf of papers to the inside of the spine via the binding agent, and automatically readable metallic indication means associated with the cover.

2. A cover according to claim 1, wherein the indication means consists of magnetizable or magnetic material.

3. A cover according to claim 1, wherein the indication means is attached in the area of the spine of the cover.

4. A cover according to claim 3, wherein the indication means is attached between the spine of the cover and the binding agent, inside the binding agent or on the side of the binding agent farthest away from the spine.

5. A cover according to claim 1, wherein the binding agent is a strip of melt glue.

6. A method for binding sheaves of papers into covers such as to form booklets, each booklet comprising a cover made up of two cover sheets, a spine therebetween, indication means associated with the cover, a binding agent attached to the inside of the spine, and a sheaf of papers inserted in the cover, one side edge of the sheaf being positioned adjacent to the inside of the spine, comprising the steps of activating the binding agent by an activation device such that said side edge of the sheaf of papers will be connected to the inside of the spine via the binding agent, and sensing the non-presence of the indication means on the cover using a sensing means to thereby activate a control means for preventing binding of the sheaves in the absence of the indication means.

7. A method according to claim 6, further comprising the step of inhibiting the activation device via the control means so that a cover not having indication means therein can be utilized in the method.

8. A method according to claim 6, further comprising the step of moving the cover toward the activation device while the sensing means senses the presence or non-presence of the indication means.

9. A method according to claim 6, wherein the indication means is a magnet, further comprising the step of sensing the magnetic properties of the magnet.

10. A method for binding sheaves of papers into covers such as to form booklets, each booklet comprising a cover made up of two cover sheets, a spine therebetween, indication means associated with the cover, a binding agent attached to the inside cover of the spine, and a sheaf of papers inserted in the cover, one side edge of the sheaf being positioned adjacent to the inside of the spine, comprising activating the binding agent by an activation device such that said side edge of the sheaf of papers will be connected to the inside of the spine via the binding agent, sensing the presence or non-presence of the indication means associated with the cover and actuating control means for inhibiting connection of the sheaf of papers to the cover in the case of non-presence of the indication means.

11. A cover comprising two cover sheets and a spine therebetween, a binding agent attached to the inside of the spine, and a sheaf of papers intended to be inserted in the cover between the two cover sheets, such that one side edge of the sheaf of papers bears against the side of the binding agent farthest away from the spine, the binding agent being intended to be activated for connecting the sheaf of papers to the inside of the spine via the binding agent to constitute a complete booklet, and the cover with the sheaf of papers not inserted therein having associated therewith metallic indication means which is automatically readable for controlling further assembly of the booklet.

12. A cover comprising two cover sheets and a spine therebetween as well as a binding agent attached to the inside of the spine, a sheaf of papers being intended to be inserted in the cover between the two cover sheets, such that one side edge of the sheaf of papers bears against the side of the binding agent farthest away from the spine, the binding agent being intended to be activated for connecting the sheaf of papers to the inside of the spine via the binding agent, the cover being provided with automatically readable indication means comprising one or a plurality of wires or strips, the wires or strips being arranged at a distance from each other preferably in the longitudinal direction of the spine, wherein the number of wires or strips and/or the distance between the wires or strips indicates the width of the spine.

13. A cover comprising two cover sheets and a spine therebetween as well as a binding agent attached to the inside of the spine, a sheaf of papers being intended to be inserted in the cover between the two cover sheets, such that one side edge of the sheaf of papers bears against the side of the binding agent farthest away from the spine, the binding agent being intended to be activated for connecting the sheaf of papers to the inside of the spine via the binding agent, the cover being provided with automatically readable indication means comprising one or a plurality of wires or strips, wherein the thickness or the width of the wires or strips indicates the width of the spine.

14. A cover comprising two cover sheets and a spine therebetween, a binding agent attached to the inside of the spine, a sheaf of papers being intended to be inserted in the cover between the two cover sheets, such that one side edge of the sheaf of papers bears against the side of the binding agent farthest away from the spine, the binding agent being intended to be activated for connecting the sheaf of papers to the inside of the spine via the binding agent, and automatically readable indication means associated with the cover, wherein the indication means indicates the width of the spine.

15. A cover comprising two cover sheets and a spine therebetween, a binding agent attached to the inside of the spine, a sheaf of papers being intended to be inserted in the cover between the two cover sheets, such that one side edge of the sheaf of papers bears against the side of the binding agent farthest away from the spine, the binding agent being intended to be activated for connecting the sheaf of papers to the inside of the spine via the binding agent, and automatically readable indication means associated with the cover, wherein the indication means comprises at least one wire or strip.

16. A cover according to claim 15, wherein a number of wires or strips are attached at a distance from each other preferably in the longitudinal direction of the spine, the number of wires or strips indicating the width of the spine.

17. A cover according to claim 15, wherein a number of wires or strips are attached at a distance from each other preferably in the longitudinal direction of the spine, the distances between the wires or strips indicating the width of the spine.

18. A cover according to claim 15, wherein the thickness or the width of the wire or strip indicates the width of the spine.

* * * * *